US011046396B2

(12) United States Patent
West

(10) Patent No.: US 11,046,396 B2
(45) Date of Patent: Jun. 29, 2021

(54) ADJUSTABLE SURFBOARD FIN AND METHOD OF USE

(71) Applicant: Benjamin Gene West, Capitola, CA (US)

(72) Inventor: Benjamin Gene West, Capitola, CA (US)

( * ) Notice: Subject to any disclaimer, the term of this patent is extended or adjusted under 35 U.S.C. 154(b) by 0 days.

(21) Appl. No.: 16/852,199

(22) Filed: Apr. 17, 2020

(65) Prior Publication Data

US 2021/0001961 A1 Jan. 7, 2021

Related U.S. Application Data

(60) Provisional application No. 62/871,171, filed on Jul. 7, 2019.

(51) Int. Cl.
*B63B 32/66* (2020.01)
*B63B 32/64* (2020.01)

(52) U.S. Cl.
CPC ..... *B63B 32/64* (2020.02); *B63B 32/66* (2020.02)

(58) Field of Classification Search
CPC ..... B63B 32/60; B63B 32/64; B63B 32/66; B63B 32/53; B63B 32/56
See application file for complete search history.

(56) References Cited

U.S. PATENT DOCUMENTS 4,883,436 A * 11/1989 Oakland ..... B63B 32/60 441/65
5,152,705 A * 10/1992 Rock ..... B63B 32/66 441/74
5,224,435 A * 7/1993 Kinnaird ..... B63B 32/66 114/127

FOREIGN PATENT DOCUMENTS

FR 2960850 A1 * 6/2010 ..... B63B 41/00
WO WO-8809744 A1 * 12/1988 ..... B63B 32/66

* cited by examiner

*Primary Examiner* — Andrew Polay
(74) *Attorney, Agent, or Firm* — Mark S Hubert PC

(57) ABSTRACT

A surfboard fin assembly for the flush incorporation into a surfboard body that allows for adjusting the depth the fin extends below the surfboard. It has a biasing means that maintains the fin in the down position yet allows upward movement upon the application of upward force such as when the fin is struck from below. The fin is perpendicularly affixed to a hinge body that is pivotally housed in an open ended fin box that is integrated into the volume of the surfboard body. A means for tensioning is releasably attached at a distal end to the hinge body and at a proximal end to the surfer's ankle. The height of the fin is adjustable through the means for tensioning and sets the performance of the surfboard to the surfer's desired level of directional control depending on their type of surfing. The fin or fin and hinge body are interchangeable with other design of fins.

11 Claims, 10 Drawing Sheets

ADJUSTABLE SURFBOARD FIN AND METHOD OF USE

CROSS-REFERENCE TO RELATED APPLICATION

This application claims the benefit of U.S. Provisional Patent Application No. 62/871,171, filed Jul. 7, 2019 which is incorporated by reference herein in its entirety.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to surface water sports, and more particularly to stand up surfing and the performance of the associated surfboards.

BACKGROUND

Surfboarding is beyond a watersport. For many living in coastal areas, it is a way of life. However, each person's experience with their surfboard is unique. The boards vary greatly in design and length to accommodate the various different riding styles and preferences. For many, a tube ride in the big waves is the goal, while for others carving or performing tricks such as aerials (with rotation or straight), cutbacks, top turns, flips and grabs on the board is the ultimate. Simply stated, there is a plethora of different riding styles and objectives on a surfboard.

The one thing in common for all surfboard maneuvers, is that the board direction must be allowed to be dictated by the surfer. Since the surfboard is basically a hydro-dynamic plank, without a perpendicular fin that resides deeper in the water, there is little below the surface to allow the surfer to grab the water and steer their course of direction. The surfboard's fin (or fins) are designed to continuously track the nose of the surfboard in a leading position in relation to the surfboard's tail while moving. When in a forward trajectory, the surfer transfers their body weight on the top of the surfboard to navigate (steer) the surfboard. This body weight transfer changes the board's (hull) position which in turn also changes the fin's orientation in the water.

Notably, besides acting as a rudder to steer, the fin also serves to prevent sideways motion of the surfboard. The deeper the surfboard's fin is in the water the greater the directional stability of the surfboard with respect to its linear axis while in a forward trajectory. However, such directional stability is not desirable for all styles of riding. Trick or stunt surfers often want a minimum of depth or absence of the fin in the water so that the board can quickly be rotated on the surface of the water.

While surfboard design has evolved as its technology has improved, surfboard fins have seen minimal improvements. Basically, they remain rigid planar members, mechanically affixed and solidly locked onto the bottom side of the surfboard's tail section. Thus, the surfboard fin cannot be altered, moved, or disengaged in relation to the surfboard body by the user.

Henceforth, an improved fin design that allows the different surfers to control and steer the surfboard to suit their particular style of surfing that day, would fulfill a long felt need in the surfing industry. This new invention utilizes and combines known and new technologies in a unique and novel configuration to overcome the aforementioned problems and accomplish this.

BRIEF SUMMARY

In accordance with various embodiments, a surfboard with a replaceable, interchangeable fin that can adjust its depth while in use, so as to provide a new and improved style of surfing, is provided.

In one aspect, a surfboard with a depth adjustable fin that can be adjusted by manipulation of the leash around the ankle of the surfer, while the surfboard is in motion, is provided.

In another aspect, a surfboard fin that is torsionally or otherwise predisposed for complete insertion under the surfboard, yet may be removed partially or entirely by application of an upward tensional or compressive force from below, is provided.

In yet another aspect, a method of riding a surfboard wherein the depth the fin resides in the water is adjusted by the rider while the surfboard is in use.

In yet another aspect, a surfboard fin assembly for integration into a surfboard body, that incorporates a downward biased, forward pivotable fin in a housing having an open back end to accommodate the pivotal movement of the fin from the housing.

In a final aspect, a surfboard fin assembly with a pivotable fin able to rise or lift upward from its fully inserted position in its housing upon contact from an object below the bottom of the surfboard, to protect the fin from damage.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION OF CERTAIN EMBODIMENTS

Figure 1:
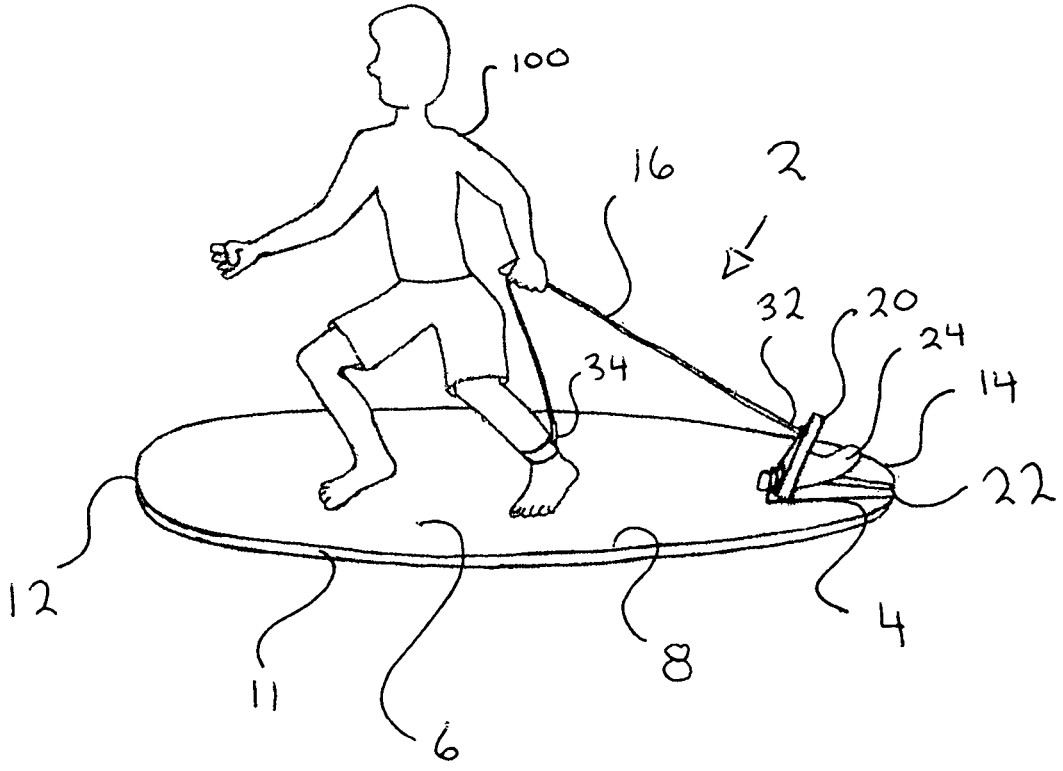
FIG. 1 is a perspective view of a surfer on a surfboard applying a force to the means for tensioning so as to raise and pivot the fin from the top, front edge of the fin box.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In the following description, for the purposes of explanation, numerous specific details are set forth in order to provide a thorough understanding of the described embodiments. It will be apparent to one skilled in the art, however, that other embodiments of the present invention may be practiced without some of these specific details. It should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein, the term "fin" refers to a generally planar member that is disposed at the back end of a surface watersport board so that its plane resides perpendicular or relatively perpendicular (within 45 degrees) to the X-Y plane in a three-dimensional Cartesian coordinate system.

As used herein, the term "biased or predisposed" with respect to the fin, refers to a downward force (torsional or linear) exerted on the fin by the biasing means, that coerces the front pivoting fin into a fully down position within the fin housing of the fin assembly where the fin will remain without the influence of any other external forces. Such forces to pivot the fin in an upward arc could be an upward tension force (angular or straight) from the pull of a leash connected to the top edge of the fin, or alternatively, from an upward compressive force exerted on the bottom edge of the fin in the case when the fin strikes a rock or the sand.

As used herein, the term "biasing means" refers to any of a group of springs, torsional or linear (compressive or tensional) connected between the fin and the surfboard body, or the fin and the fin housing, so as to urge the fin into its fully downward position within the fin housing.

As used herein, the term "means for tensioning" refers to a flexible connector (herein a leash, or lead or a rope) affixed to at least the fin that may be tensioned to cause the fin to pivot from its fin housing upon the application of a tension force that exceeds the force the biasing means imposes on the fin.

The present invention relates to a novel design for a surfboard fin assembly for incorporation into a surfboard body, where the fin assembly has a front pivotable, downward biased, vertically adjustable fin, located in a fin housing and coupled to the surfboard leash; and a method for riding a surfboard that entails raising and lowering the fin while the surfing. Adjusting the depth, the fin extends below the surfboard into the water sets the performance of the surfboard to the desired level of directional control. Having the fin only biased in its down position rather than permanently affixed, allows the fin to move upward when struck thereby avoiding damage.

Figure 10:
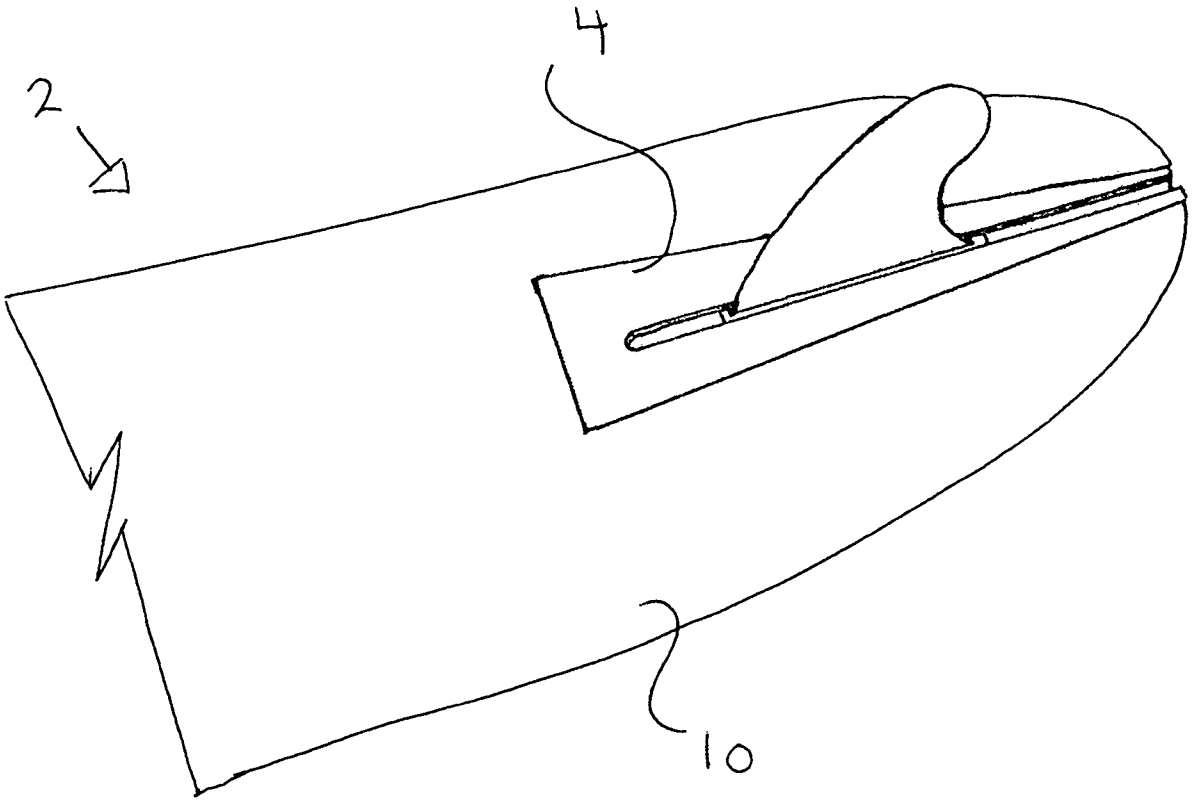
FIG. 10 is a bottom, perspective view of a surfboard with an adjustable fin assembly.

Looking at FIGS. 1 and 10, a surfboard 2 with an adjustable, replaceable, hinged surfboard fin assembly 4 (FIGS. 3 and 4) installed, can best be seen. The surfboard hull 6 is a buoyant body consisting of a generally planar top 8, a generally planar bottom 10 (FIG. 10), a circumferential side 11 disposed between the bottom 10 and the top 8, a nose 12, and tail 14. A means for tensioning 16 (illustrated here as a leash), has connected at its distal end, a releasable leash plug 18 which is frictionally fastened into a plug orifice 19 in the top of the hinge body 20. The hinge body 20 is pivotally attached to the fin box 22. The hinge body 20 has the fin 24 affixed perpendicularly from the hinge body's bottom face 26. The proximal end of the hinge body 28 is pivotally connected to the fin box 22 by a biasing means 30 (FIGS. 3 and 4) and releasably connected at its distal end 34 by the means for tensioning 16 to the surfer's ankle. Directional arrow 60 shows the direction of pivotal movement that a surfer can introduce to the hinge body 20 and fin 24 while surfing.

Figure 6:
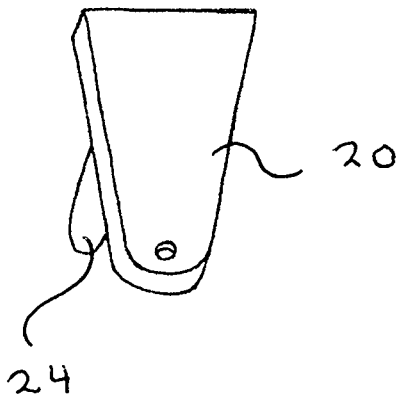
FIG. 6 is a top, perspective view of the pivot plate and fin.
Figure 7:
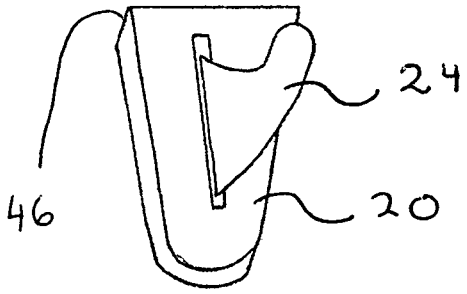
FIG. 7 is a bottom, perspective view of the pivot plate and fin.
Figure 8:
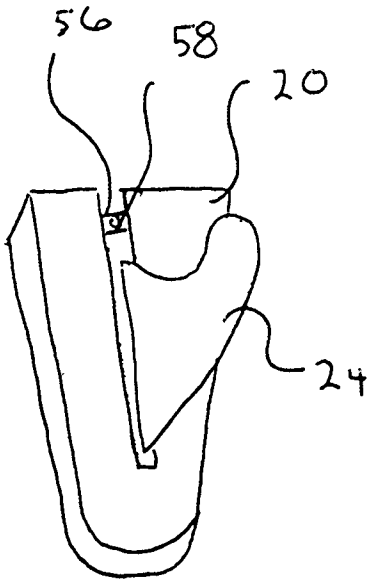
FIG. 8 is a bottom, perspective view of the alternate pivot plate and fin.

The hinge body 20 shown in FIGS. 6, 7 and 8 is a planar body having a fin 24 affixed along its longitudinal centerline. Preferably it is an enclosed body with a generally planar top face and generally planar bottom face (within the realms of the matching curvature of the surfboard it is incorporated into) so to minimize any drag or friction that it could encounter from water rushing by. It is pivotally attached to the surfboard assembly either at the surfboard itself or at the fin box 22. The fin 24 extends from the bottom face of the hinge body 20 and may be affixed to the hinge body in various ways. It may be permanently affixed by adhesive means, welding, fiber glass, or with mechanical fasteners such as rivets, screws or the mechanical equivalent, such as is well known in the industry. In one embodiment it is removably mounted into a T-slot in the hinge body 20.

Figure 9:
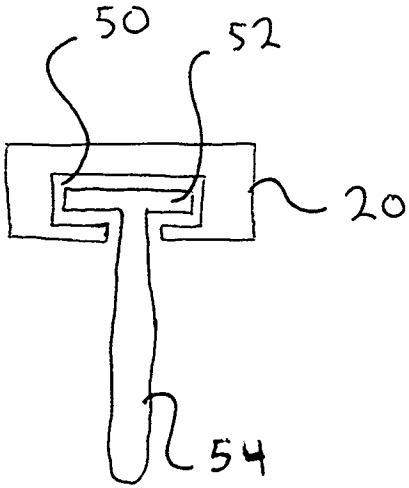
FIG. 9 is a cross sectional view of the alternate pivot plate and fin taken through the vertical centerline of the fin.

The hinge body 20 shown in the alternate embodiment of FIGS. 8 and 9, has a removeable fin 24 that slides into a longitudinal T-slot 50 along the centerline of the hinge body 20. In this design, the fin 24 has a flange 52 at its top end, residing perpendicular to the fin blade 54 that slidingly engages the T-slot 50. With the fin 24 slid entirely to the extent of the T-slot a locking T-nut 56 is also slid down the T-slot 50 until it abuts the fin 24 and then its bolt 58 tightened until it frictionally engages the inner face of the T-slot. This type of arrangement to lock a fin in a perpendicular position is commonly used on paddle boards.

One of the novel features of this design is that the fin 25 is replaceable with different shape and dimensioned fins, depending of the surfer's preference. If the fin 24 is permanently affixed to the hinge body 20, the entire hinge body/fin assembly will have to be interchanged by separating the first leaf 40 and second leaf 42 of the biasing means 30. If the hinge body 20 has a T-slot to slidingly accommodate a fin 24, (as discussed further herein) the fin can be interchanged on the fly, outside of a surf shop.

Figure 3:
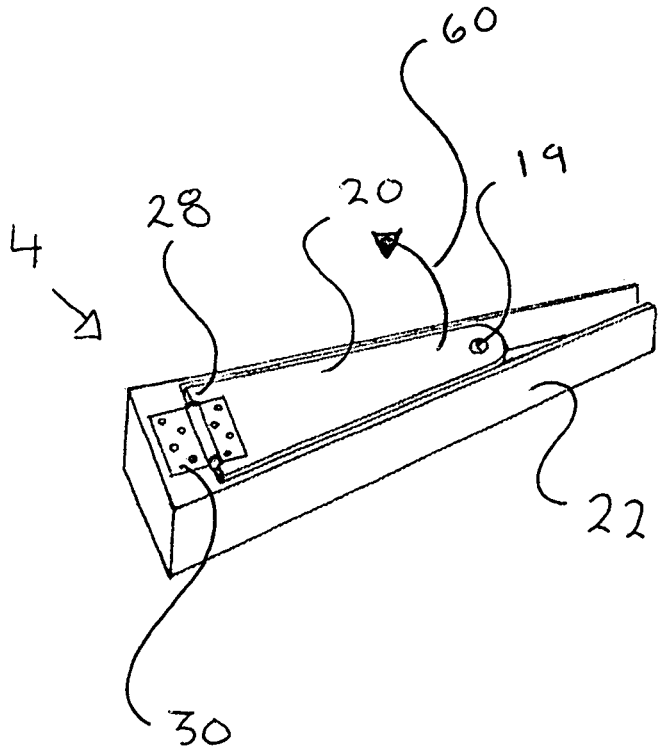
FIG. 3 is a top, side perspective view of the fin assembly with the fin in a down (biased) position.
Figure 5:
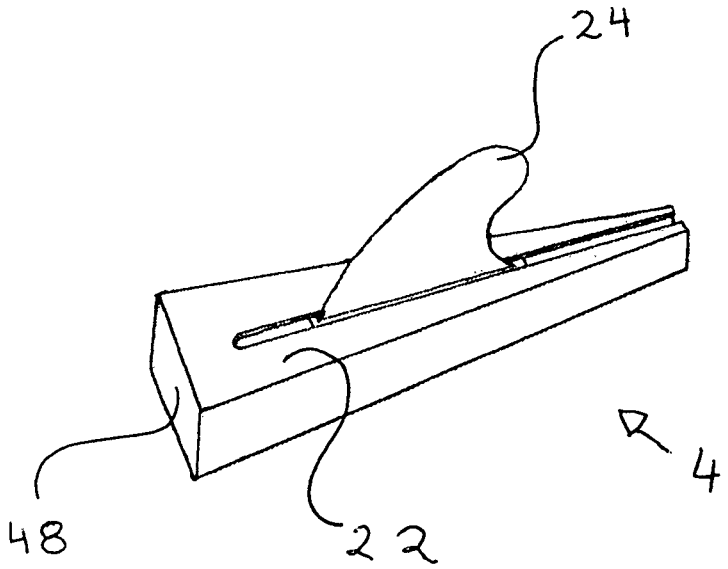
FIG. 5 is a bottom, side perspective view of the fin assembly with the fin in a down (biased) position.

Looking at FIGS. 3 and 5 it can be appreciated that the fin box 22 is configured as an open-ended trapezoid with its open (distal) end at the tail 14 of the surfboard 2. It is a linear framework with only three walls (sides), no top, no bottom and no distal end wall (side.) It serves to provide a space for the hinge body 20 with its fin 24 to reside and be able to pivot forward and upward, free of any lateral friction from the surfboard assembly. For this reason, its front end and sides closely approximate the configuration of the hinge body 20.

The fin box 22 has three side walls and an open distal end. The three side walls are the same dimensional vertical height as the section of the surfboard 2 that they are incorporated into. These side walls function as a surface for the attachment and incorporation of the fin box 22 into the volume of the surfboard 2. Depending on the construction of the surfboard, the fin box 22 may be fiber glassed, glued or otherwise mechanically affixed to reside within, yet flush with, the contours of the surfboard 2. The distal end of the fin box 22 has no side and is open ended so as to allow clearance for the fin 24 as is pivots vertically upward with the hinge body 20. The distal end could be closed and the fin box 22 moved toward the front of the surfboard 2, but it is imperative for the fin 24 to sit as far as back in the surfboard 2 as practical to enhance the steering effect on the nose 12 of the surfboard. The fin box 22 is made of a lightweight but strong material, likely a carbon fiber, strengthened polymer, or aluminum as it must withstand the torsional forces exerted by the first leaf 40 of the biasing means 30 without failure. (These torsional forces are transmitted from the lateral forces the water exerts on the fin 24 in the fin's normal function as a fixed rudder.) It would appear that there need not be a fin box 22 with its long tailing non-parallel sides, but rather just an opening in the surfboard with a front plate to affixed the first leaf 40 of the biasing means 30 to. This is incorrect. The long sides of the fin box 22 strengthen its front face 46 from twisting under the lateral loads on the fin 24, gaining their strength from the selection of material and their large connected surface areas to the surfboard.

Although depicted as trapezoidal, it is known that the fin box 22 and its hinge body 20 may be made in other geometrical operable equivalents such as an ellipse, rectangle, triangle and the like, although they will all require that their distal end be open.

Figure 2:
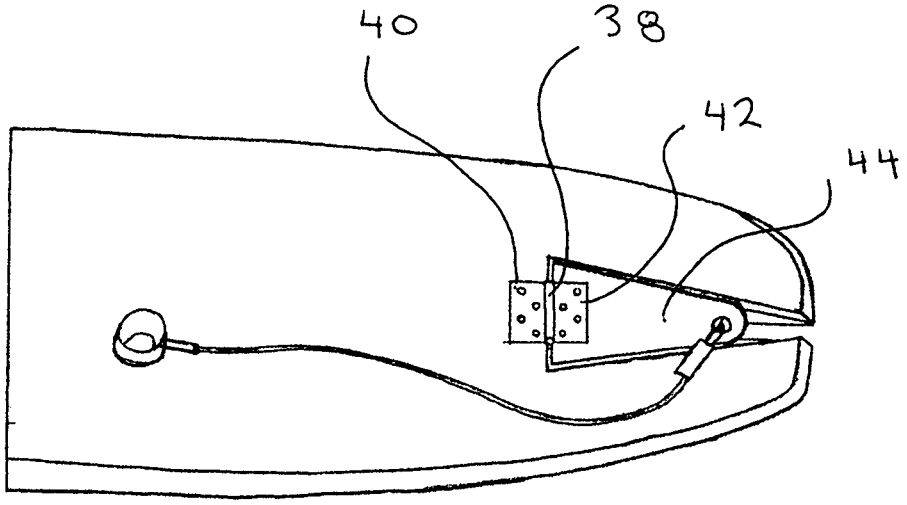
FIG. 2 is a bottom view of a surfboard with an adjustable fin assembly.

The biasing means 30 in the preferred embodiment will be a torsional (wound) spring hinge 38 operably disposed between a first leaf 40 and a second leaf 42 as is well known in the art. The first leaf 40 is affixed to the surfboard 2 as shown in FIG. 2 and the second leaf 42 is affixed to the top face of the hinge body 44 (or optionally, to the front face of the hinge body 46). In the illustrated embodiment, both leaves 40 and 42 will have to be recessed into the surfboard and the hinge body 20 so as to reside flush with the overall contour of the surfboard assembly. With the biasing means affixed between the hinge body 20 and the fin box 22, the pivot point from which the hinge body 20 and resultant fin 24 rise vertically upward from the water, resides just forward of the front wall 48 of the hinge body 20, at the midpoint of the torsional spring in the biasing means 30. The direction of pivotal movement of the hinge body 20 is indicated by directional arrow 60. (FIG. 3)

Figure 4:
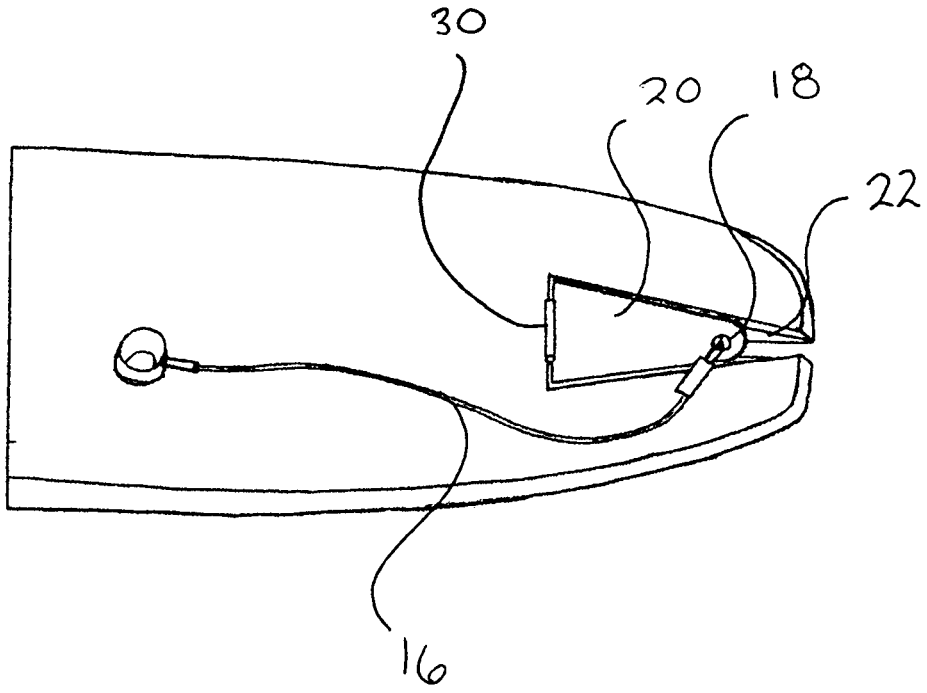
FIG. 4 is a top, side perspective view of an alternate embodiment fin assembly with the fin in a down (biased) position.

FIG. 4 shows an alternate assembly wherein the torsional spring hinge 38 of the biasing means 30 has it first leaf 40 affixed to the rear side of the front side wall 48 of the fin box 22, (FIG. 5) and has its second leaf 42 affixed to the front face of the hinge body 46. While the preferred embodiment biasing means 30 uses a torsional spring hinge 38, there are a number of mechanical equivalents that could also accomplish the biased pivotal motion of the hinge body 20 within the fin box 22 such as wound linear springs, elastic cords and the like. In the way of an example, a pair of elastic cords affixed between the back end of the hinge body 20 and the back end of the fin box 22 would also bias the hinge body 20 in a downward position.

Figure 11:
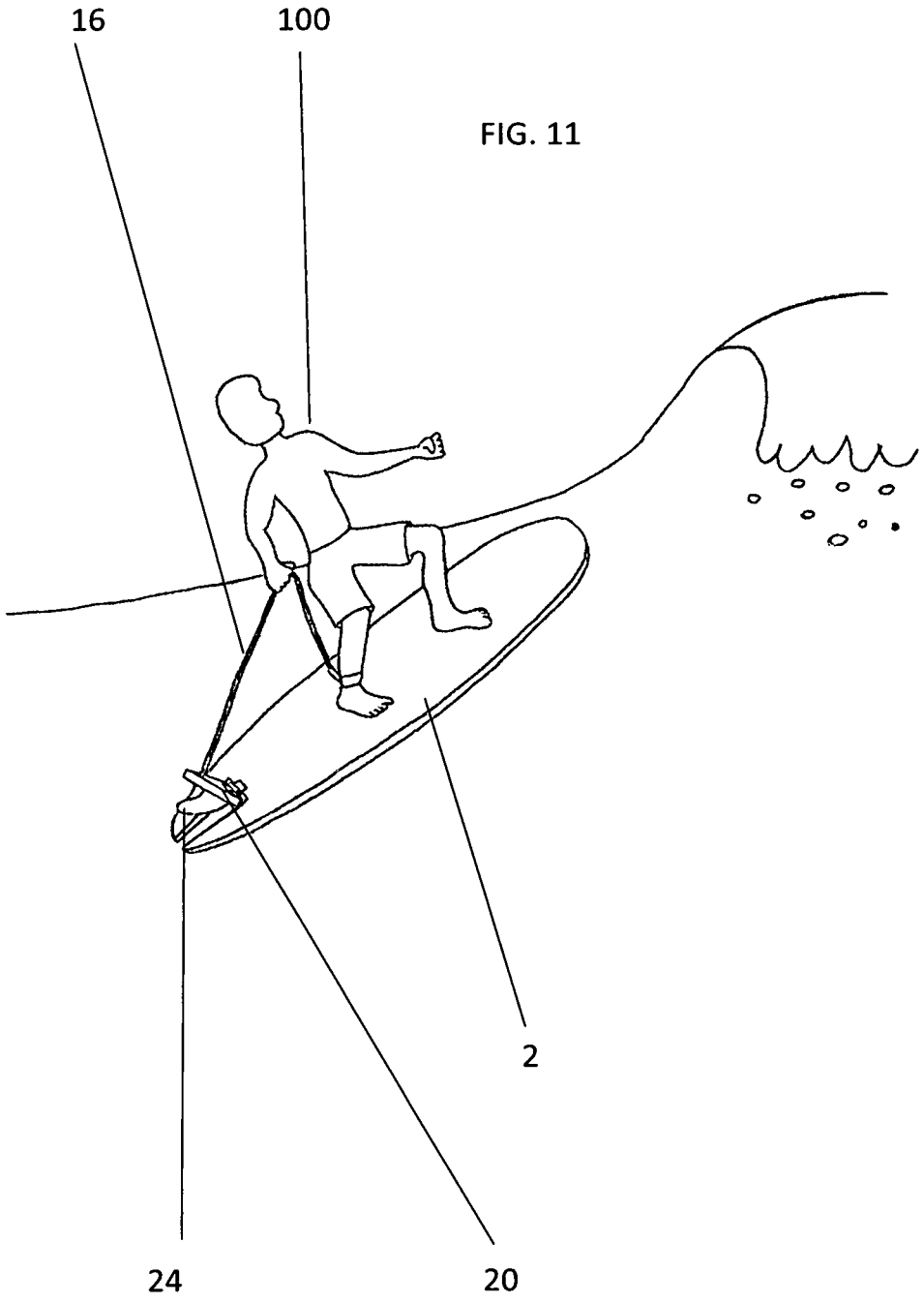
FIG. 11 is a perspective view of a surfer riding a surfboard while raising the fin.
Figure 12:
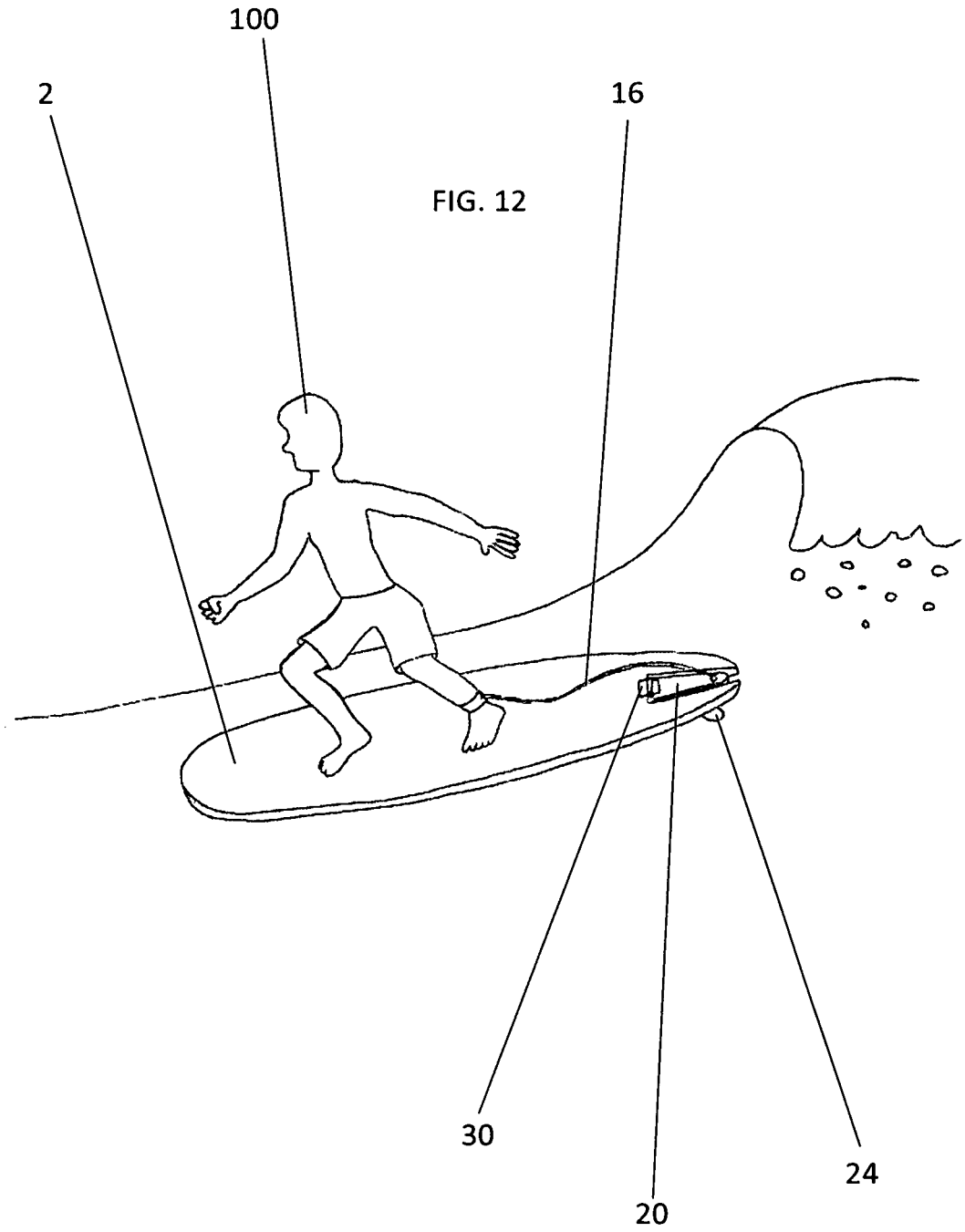
FIG. 12 is a perspective view of a surfer riding a surfboard with the fin down.

FIGS. 1, 11 and 12 best illustrate the operations of the adjustable surfboard fin assembly. A surfer 100 frictionally, releasably attaches the distal end of the means for tensioning 16 into the plug orifice 19 and attaches the proximal end of the means for tensioning 16 around his ankle. The surfer 100 mounts the surfboard 2 and enters the water with the fin 24 maintained in its predisposed, downward biased position by the tensional spring forces of the biasing means 30. The surfer 100 paddles or rides the surfboard 2 to a desired position in the water (FIG. 12) and when the surfboard gains forward momentum and begins upon a trajectory, they rise vertically to stand on the surfboard 2. Positioned on top of a surfboard 2 the surfer 100 pulls on the means for tensioning 16 until the hinge body 20 pivots at its proximal end 26 about the pivot point of the biasing means 30. The surfer 100 adjustably trims (raises or lowers the fin by changing the tension on the means for tensioning 16) the fin 24 as needed to adjust the level of side slip they want the surfboard to have on the water so they can perform their maneuvers. (FIG. 11) Once finished, the surfer 100 releases the tension on the means for tensioning 16 to lower the fin 24 into the water so that they can have directional control to steer the surfboard back to shore or to another location in the water.

While described in terms of an adjustable surfboard fin, it is known that it is a surfboard fin assembly intended for incorporation into a surfboard at the time of fabrication although it may also be manufactured and sold as a kit for retrofitting into an existing surfbord.

Having described and illustrated the principles of the inventive concept with reference to illustrated embodiments, it will be recognized that the illustrated embodiments can be modified in arrangement and detail without departing from such principles, and can be combined in any desired manner.

Consequently, in view of the wide variety of permutations to the embodiments described herein, this detailed description and accompanying material is intended to be illustrative only, and should not be taken as limiting the scope of the inventive concept. What is claimed as the invention, therefore, is all such modifications as may come within the scope and spirit of the following claims and equivalents thereto.

Having thus described the invention, what is claimed as new and desired to be secured by Letters Patent is as follows:

1. An adjustable surfboard fin assembly, comprising:

an open ended fin box;

a hinge body having a hinge body proximal end, a hinge body distal end, a top planar face and a bottom planar face;

a fin affixed to, and extending perpendicular from said bottom planar face;

a biasing means pivotally connected between said hinge body and said fin box; and a means for tensioning, connectable at a proximal end to a surfer and releasably connectable at a distal end to said hinge body.

2. The adjustable surfboard fin assembly of claim 1 wherein said biasing means comprises a torsion spring disposed between a first leaf and a second leaf.

3. The adjustable surfboard fin assembly of claim 2 wherein said first leaf is connected to said fin box and said second leaf is connected to a said hinge body.

4. The adjustable surfboard fin assembly of claim 3 wherein said means for tensioning has a plug affixed to said distal end.

5. The adjustable surfboard fin assembly of claim 1 wherein said hinge body is an enclosed body with a generally planar top face and generally planar bottom face having a plug orifice formed adjacent to said distal end, said plug orifice sized for frictional mating engagement with said plug.

6. The adjustable surfboard fin assembly of claim 1 wherein said fin box has a trapezoidal configuration having three sides and an open distal end.

7. The adjustable surfboard fin assembly of claim 5 wherein said fin has a flange extending perpendicularly from its top end insertable into a T-slot formed in said hinge body.

8. An adjustable surfboard fin assembly, comprising:

an open ended fin box;

a hinge body having a proximal end, a distal end, a top planar face and a bottom planar face;

a fin affixed to, and extending perpendicular from said bottom planar face;

a biasing means pivotally connected between said hinge body and a surfboard; and a means for tensioning connectable at a proximal end to a surfer and connectable at a distal end to said hinge body.

9. A method of a surfer using an adjustable surfboard fin assembly, comprising of the steps of:

releasably attaching a distal end of a means for tensioning to a pivotable hinge body;

mounting a surfboard with an adjustable surfboard fin assembly and entering the water with a fin on said surfboard maintained in a downward biased position by a biasing means;

paddling said surfboard to a desired position in the water;

rising vertically to stand on said surfboard when said surfboard gains forward momentum and begins upon a trajectory;

tensioning on said means for tensioning until said hinge body pivots about a pivot point of said biasing means to adjustably trim said fin vertically as needed to adjust the level of side slip said surfboard experiences;

releasing the tension on the means for tensioning to allow said biasing means to lower said fin vertically into the to maximize surfboard steering so that they can have directional control to steer the surfboard back to shore or to another location in the water.

10. The method of a surfer using an adjustable surfboard fin assembly of claim 9, further comprising of the first step of:

attaching a proximal end of said means for tensioning to themselves.

11. The method of a surfer using an adjustable surfboard fin assembly of claim 9 wherein said adjustable surfboard fin assembly comprises:

an open ended fin box;

a hinge body having a hinge body proximal end, a hinge body distal end, a top planar face and a bottom planar face;

a fin affixed to, and extending perpendicular from said bottom planar face;

a biasing means pivotally connected between said hinge body and said fin box; and a means for tensioning, connectable at a proximal end to a surfer and releasably connectable at a distal end to said hinge body.

* * * * *